US006284959B1

(12) United States Patent
Nicolosi

(10) Patent No.: US 6,284,959 B1
(45) Date of Patent: Sep. 4, 2001

(54) PRACTICE PERCUSSION ASSEMBLY

(76) Inventor: Kathy Lord Nicolosi, 58 Bay 17th St., Brooklyn, NY (US) 11214

( * ) Notice: Subject to any disclaimer, the term of this patent is extended or adjusted under 35 U.S.C. 154(b) by 0 days.

(21) Appl. No.: 09/542,425

(22) Filed: Apr. 4, 2000

(51) Int. Cl.[7] ..... G10D 13/02
(52) U.S. Cl. ..... 84/411 P; 84/411 R; 84/414
(58) Field of Search ..... 84/411 P, 411 R, 84/414

(56) References Cited

U.S. PATENT DOCUMENTS

| | | | | |
|---|---|---|---|---|
| 2,547,840 | | 4/1951 | Smith | 5/722 |
| 3,113,480 | | 12/1963 | Giarratano | 84/411 R |
| 3,166,970 | * | 1/1965 | Ellman | 84/411 R |
| 3,264,926 | * | 8/1966 | Belli | 84/411 R |
| 4,102,235 | | 7/1978 | Le Masters | 84/411 R |
| 4,589,323 | | 5/1986 | Belli et al. | 84/411 R |
| 4,930,628 | * | 6/1990 | Bridges | 206/45.23 |
| 5,962,799 | * | 10/1999 | Hsieh | 84/422.1 |

FOREIGN PATENT DOCUMENTS 2217091A 10/1989 (GB) .

* cited by examiner

*Primary Examiner*—Shih-Yung Hsieh
(74) *Attorney, Agent, or Firm*—Levisohn, Lerner, Berger & Langsam

(57) ABSTRACT

A practice percussion assembly in the form of a practice drum kit is provided. The assembly includes a main member having a main surface made of a first percussion material and at least one subordinate, preferably smaller, member having a subordinate surface of a second material different from the first percussion material. The smaller subordinate member is mountable to the base member. The second percussion material produces a different sound when struck than the first percussion material. The subordinate member preferably has an angled back wall formed at an angle to a primary plane of the subordinate percussion member. The angled back wall engages a side wall of the main member to be able to maintain the subordinate member at an angle to the main member to simulate the layout of a real drum set.

40 Claims, 4 Drawing Sheets

PRACTICE PERCUSSION ASSEMBLY

BACKGROUND OF THE INVENTION

1. Field of the Invention

The invention relates to percussion instruments, and more specifically to a percussion or drum set that can be used for practicing.

2. Description of the Related Art

Musicians need to practice their instruments in order to maintain their skills, to improve their techniques, to learn new songs, and the like. The need to practice is not limited to woodwind, brass, and stringed instruments; percussionists (drummers) need to practice their craft as well. While precise tonal quality is not of concern to a percussionist, she must practice speed, agility, and various combinations of rhythms.

However important practicing may be for a percussionist, there are many obstacles in her path. First, a drum set is extremely bulky, heavy, and difficult to set up. Consequently, a typical set occupies a lot of space and is not very portable. Also, drums are among the loudest instruments in a band. A person practicing on a drum set in a residence can be an unpleasant experience for those living in the same or nearby residences.

Several previous devices have been developed to enable the drummer to practice her craft without disturbing the neighbors. U.S. Pat. Nos. 4,102,235 to Le Masters and U.S. Pat No. 4,589,323 to Belli et al. teach muffler pads which can be placed on drums and cymbals to reduce the volume of sound produced when the drum/cymbal is struck. While these devices limit the sound produced when practicing, they do not alleviate the space and portability problems of a conventional drum set.

It is also known to provide drummers, particularly students, a practice block. The typical practice block is made of wood and includes a rubber sheet disposed on one surface of the block. The rubber absorbs most of the impact of the drumstick, and the block is generally small enough to fit into a backpack. This standard practice block provides for relatively quiet practicing on a portable device. However, the block is a small single piece of wood and has several drawbacks. Practicing on the block can give a person physical strength, but it cannot provide the drummer with the physical layout of a drum set. Consequently, practicing on a block provides the drummer with a limited amount of coordination and fails to teach the drummer about the relative positions of the pieces of a drum set. Further, the practice block makes little or no sound when struck, or at best makes one type of sound. As a result, practicing on the block can be extremely boring.

A modified practice block is taught in U.S. Pat. No. 3,113,480 to Giarratano. It provides three sections of striking surface in a foldable assembly. The sections are all the same size; one section may be propped up by a detachable leg to place its striking surface at an angle to the other striking surfaces. The Giarratano device is portable, but still fails to provide a drum kit that sufficiently resembles a drum set in physical layout. Also, all of the striking surfaces are made from the same sound dampening material. Thus, all of the sounds generated by practicing on the device will be the same; it is just as boring a device to practice with as a wood block. A student will also be unable to develop combinations of different sounds or become familiar with the various sounds that different drums make. Moreover, the leg which props up one of the surfaces of the pad is easily detachable.

While this is convenient from a portability standpoint, the leg will have a tendency to become dislodged when the device is being practiced upon, particularly when the student is practicing vigorously. The device offers little flexibility in configuration as well.

SUMMARY OF THE INVENTION

Accordingly, it is an object of the invention to provide a practice percussion assembly that is capable of producing multiple sounds when struck.

It is another object of the invention to provide a practice percussion assembly on which it is fun to practice.

It is another object of the invention to provide a practice percussion assembly that is portable.

It is another object of the invention to provide a practice percussion assembly that is easily reconfigurable and on which different sounding surfaces may be easily substituted for existing surfaces.

It is another object of the invention to provide a practice percussion assembly that may include various drum set attachments.

It is another object of the invention to provide a practice percussion assembly that resembles the physical layout of a conventional drum set.

The above and other objects are fulfilled by the invention which is a practice percussion assembly having a main percussion member and at least one subordinate percussion member. The main member preferably has a main percussion surface including a first percussion material; and the subordinate member has its own percussion surface made from a second percussion material different from the first percussion material. The second percussion material produces a different sound when struck than the first percussion material. Preferably, the assembly resembles a drum set by providing two or three subordinate members smaller than the main member and attached or attachable to the main member.

In a preferred embodiment, the subordinate members are attachable at an angle to the main member. Preferably, the subordinate members are hingedly attached to the main member. The subordinate members may be provided with a rear wall that is angled (i.e., preferably not perpendicular) to the main percussion surface. The subordinate members may be flipped on their hinges from a folded-out expanded configuration to a folded-in collapsed configuration. When in the expanded configuration, they are angled from the main surface because the angled rear wall abuts the side walls of the main member. In the expanded configuration, one percussion surface on each subordinate member is exposed to play. In the collapsed configuration, a different percussion surface (on the opposite side of the subordinate member) is presented to the user. The two sides of the subordinate member are preferably provided with different types of striking surfaces so that the user can adjust the types of sounds she is making when practicing. The subordinate members are preferably hingedly attached with a spring to the main member so that spring force will lock them in both the expanded and collapsed configurations. The collapsed configuration is more convenient for storage and transportation.

DETAILED DESCRIPTION OF THE DRAWINGS AND THE PREFERRED EMBODIMENT

Figure 1:
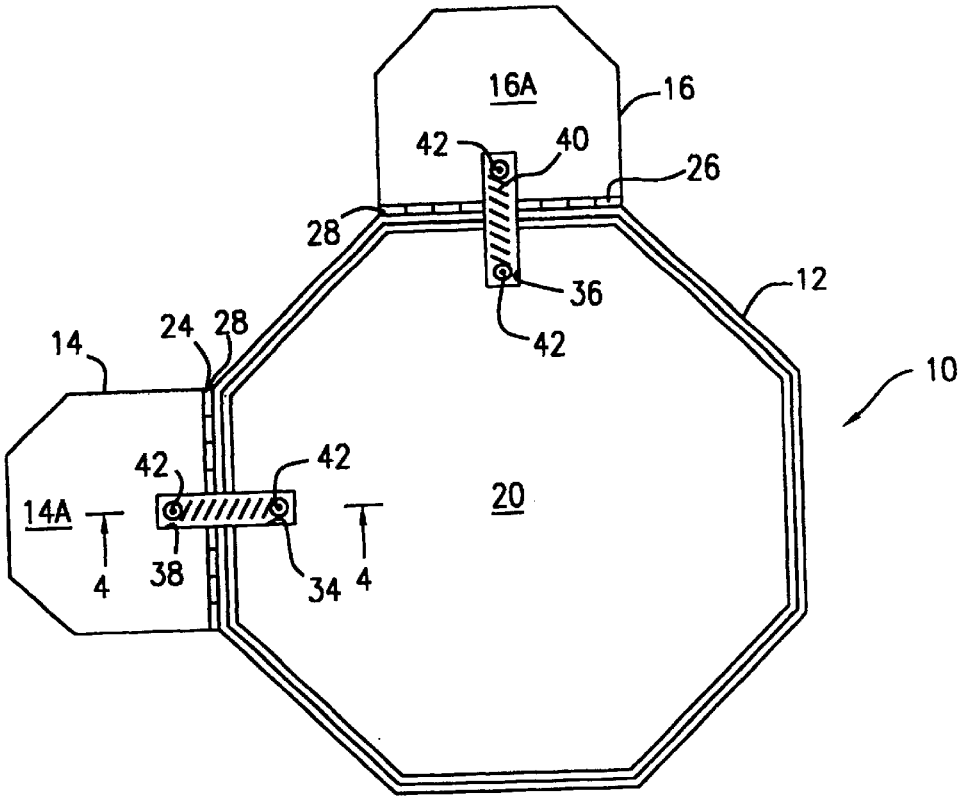
FIG. 1 is a top elevational view of an embodiment of a practice percussion assembly according to the invention in an expanded configuration.

Description will now be given of the invention with reference to FIGS. 1—8 attached hereto. It should be noted that these figures are merely exemplary in nature and do not serve to limit the scope of the invention which is defined in the claims appearing below.

The practice percussion assembly or drum kit 10 includes a main percussion member 12 and subordinate percussion members 14 and 16. Main member 12 is shown to be octagonal but could be any convenient shape, such as square, round, any other regular or irregular polygon, or any other shape. Main member 12 includes a base portion 18 on which is mounted a percussion surface 20 (see FIG. 3). Base portion 18 is preferably made from a durable substance, such as wood or metal, while percussion surface 20 may be made from a sheet of rubber or cork, a thin layer of wood, a hollow portion of wood, a thin layer of metal, a hollow portion of metal, plastic, or the like. Surface 20 is shown in section in FIGS. 4 and 5 as being made of rubber, however it could be made from any of the above substances. Main member 12 has slots 34 and 36 (see FIG. 1) formed in peripheral areas for reasons that will be explained below.

Attached or attachable to the sides 24 and 26 of main member 12 are satellite or subordinate percussion members 14 and 16. Each subordinate member 14 and 16 includes a base 30 similar to but preferably smaller than base 18 of main member 12. The shape of the subordinate percussion members is not limited by what is shown in the drawings. Each subordinate member 14, 16 includes a first percussion surface 14A, 16A placed on one side of the respective member and preferably a second percussion surface 14B, 16B placed on the opposite side of the respective member. In the preferred embodiment, percussion surfaces 14A and 16A are made from a different material than surface 20 so that different sounds are generated when striking the various surfaces 14A, 16A, and 20. For example, surface 20 could be made from one grade of rubber, while surfaces 14A and 16A could be made from a different grade of rubber. It is further preferable that surfaces 14A and 16A are also different in composition from one another, thereby maximizing the number of different sounds the assembly can generate when one is practicing upon it. It is also preferable that surfaces 14B and 16B are different in composition from surfaces 14A and 16A, respectively, and/or different from each other. In this way, the inventive assembly 10 provides up to five different surfaces upon which to play which can generate up to five different sounds, much like a real drum set has different drums, e.g., a snare, a set of tom-toms, etc. The invention thus achieves the objective of being more fun to practice on than a simple wooden block without possessing the noise problems associated with a real drum set. The subordinate members are provided with slots 38 and 40 which are aligned with slots 34 and 36 formed in the main member 12, respectively.

Figure 6:
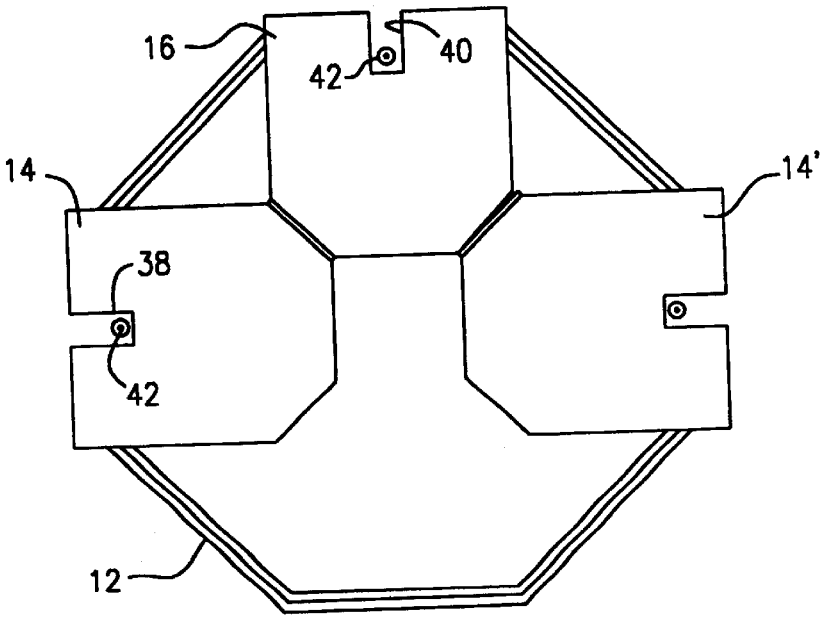
FIG. 6 is a top elevational view of another embodiment of a practice percussion assembly according to the invention in a collapsed configuration.

The preferred embodiment includes two subordinate members 14 and 16. However, any number of subordinate members as permitted by geometry, space, and cost may be included. For example, FIG. 6 depicts a practice drum set that includes two side subordinate members 14 and 14' as well as a top or central subordinate member 16.

Figure 4:
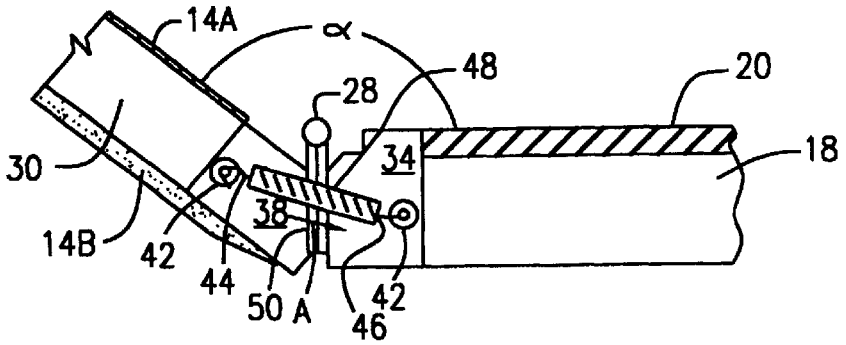
FIG. 4 is an enlarged partial cross-sectional side view taken along line 4—4 of FIG. 1.
Figure 5:
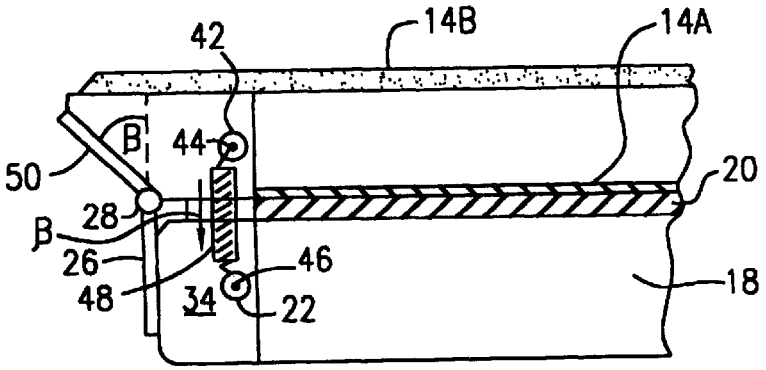
FIG. 5 is an enlarged partial cross-sectional side view taken along line 5—5 of FIG. 2.

Subordinate members 14 and 16 are positioned or positionable at an angle $\alpha$ from the main member 12. Angle $\alpha$ is preferably in the range of about 120–180°, and more preferably in the range of 135–150°. That is, percussion surfaces 14A and 16A are positionable at that angle to surface 20. This positioning is preferably accomplished by the provision of angled rear wall 50 of the subordinate members 14 and 16 (see FIG. 5), which abuts against side wall 24 or 26 of main member 12 when a subordinate member is in the expanded configuration (see FIG. 4) described below. By "angled" it is meant that the rear wall 50 of a subordinate member 14, 16 is not perpendicular to surface 14A or 16A, but rather is angled away from the perpendicular by an angle $\beta$ as shown in FIG. 5. The greater angle $\beta$ is, the smaller angle $\alpha$ is, as the two relate by the following equation:

$$\alpha=180-\beta \tag{1}$$

Figure 3:
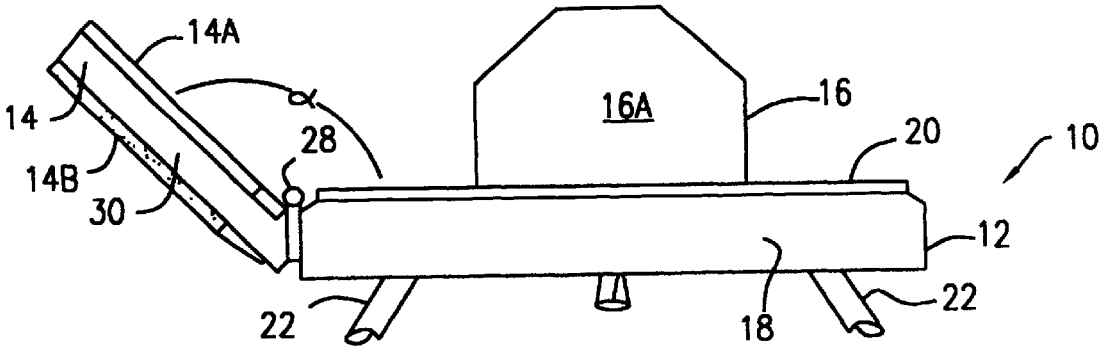
FIG. 3 is a side view of the practice percussion assembly of FIG. 1.

The placement of the subordinate members 14 and 16 at an angle to the main member 12 simulates a real drum set in its physical layout as well as in providing different sounding surfaces to each member. In a typical drum set, the main drum or drums, such as the snare and tenor drums, are placed flat in front of the musician, while the tom-toms and other smaller drums are placed above the snare/tenor at an angle. The conventional practice pad consists only of a single wooden block with one practice surface which may be flat or angled relative to the table top upon which it rests. The multiple surfaced drum pad of Giarratano provides additional space upon which to practice, but fails to accurately simulate the true physical layout of a drum set. By contrast, in the instant invention, when subordinate members 14 and 16 are in the expanded configuration as shown in FIG. 3, for example, practice surfaces 14A and/or 16A are presented to the user at an angle $\alpha$ to the main surface 20 so as to simulate the physical layout of a real drum set. The main member is preferably sized to fit into a conventional snare drum stand, and the subordinate members are optimally roughly ¼–⅕ the size in percussion surface area as the main member. Thus, if the main member 12 were approximately 12 inches across, the subordinate members 14, 16 would be about four inches by five inches or so.

Figure 2:
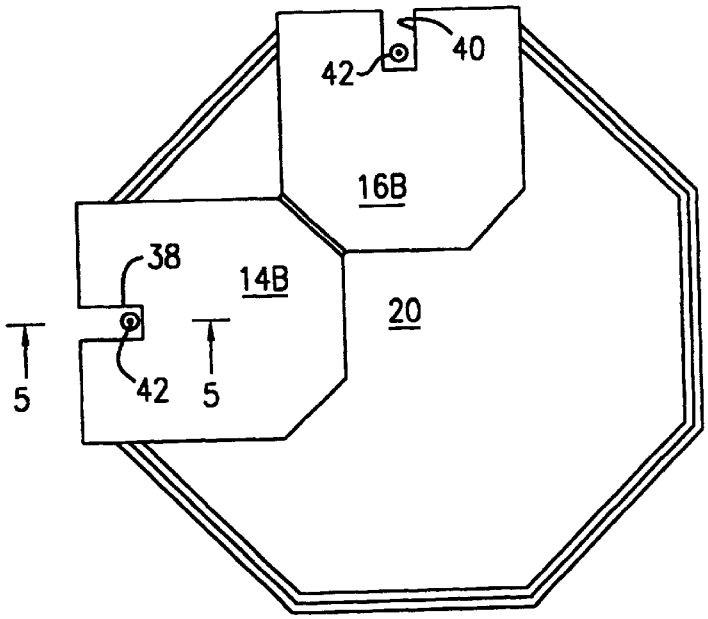
FIG. 2 is a top elevational view of an embodiment of a practice percussion assembly according to the invention in a collapsed configuration.

The subordinate members 14, 16 are preferably hingedly attached to main member 12 by hinges 28. The hinge allows the subordinate members 14 and 16 to move back and forth from an expanded configuration as shown in FIGS. 1, 3, and 4, for example, to a collapsed configuration as shown in FIGS. 2 and 5, for example. The expanded configuration more realistically simulates conventional sets of drums than do prior practice pads. The collapsed configuration is provided for two purposes. The alternate surfaces 14B and 16B of the subordinate members may be played upon in the collapsed configuration, thereby enabling a greater number of sounds to be created by the practicing musician. If the user wishes, she may fold one subordinate member into the collapsed configuration while keeping the other subordinate member in the expanded configuration; they move independently in the preferred embodiment. Also, since the subordinate members fold onto the top of surface 20, the device becomes smaller and more manageable for storing, carrying, or shipping.

It is preferable that the hinge be able to be biased into both the expanded and the collapsed configurations. In the preferred embodiment, slots 34 and 38 and slots 36 and 40 form channels between the main member 12 and subordinate members 14 and 16. As best shown in FIGS. 4 and 5, an eyelet 42 or similar securing means is disposed at the flat ends of each of the slots. A spring 48 is attached at one end 46 to the eyelet 42 which is attached to the main member 12 and at its other end 44 to the eyelet 42 which is attached to the subordinate member 14 or 16. Spring 48 is preferably a coil spring. By providing the design of the spring elements as shown in FIGS. 4 and 5, the spring 28 is pulled longer when a subordinate member is pivoted between the expanded and collapsed configurations. Thus, the spring 28 will bias the subordinate member 14, 16 into the expanded configuration via spring force as shown by arrow A in FIG. 4, pulling angled rear wall 50 into firm contact with side wall 26. Spring 28 will also bias the subordinate member 14, 16 into the collapsed configuration via spring force as shown by arrow B in FIG. 5, pulling surface 14A into firm contact with main percussion surface 20.

Figure 7A:
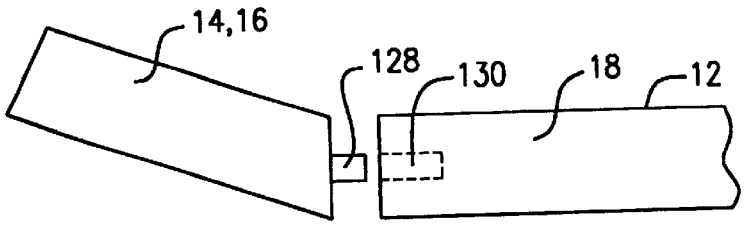
FIGS. 7A–B are schematic broken side views of alternate mounting systems of the main and subordinate members of the invention.
Figure 7B:
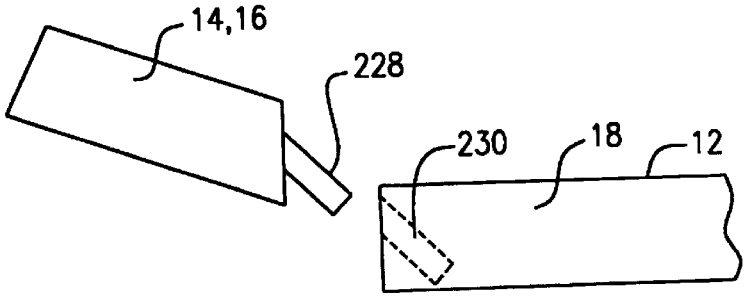

An alternate embodiment is depicted schematically in FIG. 7. Instead of providing subordinate members that are permanently hinged to the main member, the subordinate members may be attachable via a tongue and groove system. For example, as shown in FIGS. 7A–B, subordinate members 14, 16 may be provided with a projecting tongue 128 or 228 which is adapted to fit into a mating groove 130 or 230 formed in base 18 of main member 12. In FIG. 7A, tongue 130 is perpendicular to the wall from which it projects. In FIG. 7B, tongue 228 is angled and groove 230 is angled accordingly.

Figure 8:
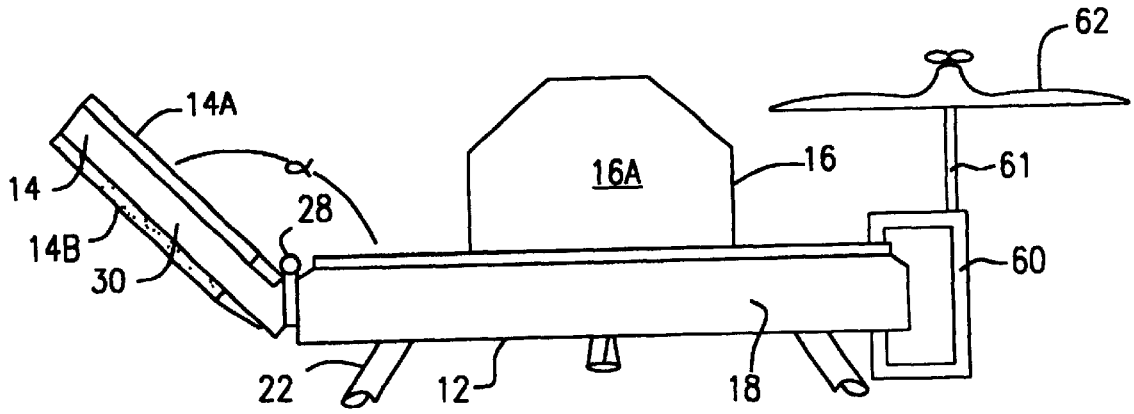
FIG. 8 is a side view of the practice percussion assembly of FIG. 1 including an additional percussion member.

As shown in FIG. 8, the invention may also include an ancillary percussion device 62 which may be selectively attached to base 18 of main member 12 via an attaching means 60. In FIG. 8, ancillary device 62 is a cymbal which is bolted to shaft 61 attached to C-clamp 60 attached to main member 12. However, any known percussion device could be attached as device 62, e.g., a cowbell, a woodblock, a washboard, one or more tom-toms, or the like. Attaching means 60 need not be limited to a C-clamp but may also be a caliper, or a bracket which can fit into a hole (not shown) bored into the side of base 18. Such a bracket would preferably be substantially L-shaped.

The invention is not limited to the above description but rather is defined by the claims appearing hereinbelow. Modifications to the above description that include that which is known in the art are well within the scope of the contemplated invention.

What is claimed is:

1. A practice percussion assembly, comprising:

a main percussion member having a main percussion surface including a first percussion material and a side wall; and at least one subordinate percussion member having a subordinate percussion surface including a second percussion material different from said first percussion material and a rear wall angled to said subordinate percussive surface and mountable to said main member with said angled rear wall selectively contactable with said side wall, wherein said second percussion material produces a different sound when struck than said first percussion material.

2. A practice percussion assembly according to claim 1, wherein said first and second percussion materials each comprises at least one of solid metal, hollow metal, solid wood, hollow wood, cork, and a rubber sheet.

3. A practice percussion assembly according to claim 1, wherein said main and subordinate percussion surfaces are each substantially planar and said subordinate percussion surface is mountable at an angle to said main percussion surface.

4. A practice percussion assembly according to claim 3, said main percussion member further comprising a groove formed in said side wall, and said subordinate percussion member including a tongue projecting from said angled rear wall, said tongue being matingly engageable in said groove.

5. A practice percussion assembly according to claim 3, said main percussion member comprising a plurality of side walls, and said assembly further comprising two subordinate percussion members each including a rear wall angled to said respective subordinate surfaces, said angled rear walls each contactable with one of said side walls, wherein said subordinate percussion surfaces are mountable at an angle to said main surface.

6. A practice percussion assembly according to claim 3, said main percussion member comprising a plurality of side walls, and said assembly further comprising three subordinate percussion members each including a rear wall angled to said respective subordinate surfaces, said angled rear walls each contactable with one of said side walls, wherein said subordinate percussion surfaces are mountable at an angle to said main surface.

7. A practice percussion assembly according to claim 5, each of said subordinate percussion members further comprising an alternate surface, opposite said subordinate surface, upon which is disposed a third percussion material, said third percussion material being different from said second percussion material thereby providing a total of five percussion surfaces in said assembly.

8. A practice percussion assembly according to claim 6, each of said subordinate percussion members further comprising an alternate surface, opposite said subordinate surface, upon which is disposed a third percussion material, said third percussion material being different from said second percussion material thereby providing a total of seven percussion surfaces in said assembly.

9. A practice percussion assembly according to claim 5, wherein said main percussion member is substantially larger than each of said two subordinate percussion members to simulate the layout of a drum set.

10. A practice percussion assembly according to claim 6, wherein said main percussion member is substantially larger than said each of said three subordinate percussion members to simulate the layout of a drum set.

11. A practice percussion assembly according to claim 1, said subordinate percussion member further comprising an alternate percussion surface, opposite said subordinate percussion surface, upon which is disposed a third percussion material, said third percussion material being different from said second percussion material.

12. A practice percussion assembly according to claim 1, wherein said subordinate percussion member is hingedly attached to said main percussion member and is movable between a first expanded configuration and a second collapsed configuration.

13. A practice percussion assembly according to claim 12, said main percussion member including a side wall and said subordinate percussion member including a rear wall angled to said subordinate percussion surface, wherein when said subordinate percussion member is in said first expanded configuration, said angled rear wall abuts said side wall of said main percussion member and said subordinate percussion surface is disposed at an angle to said main percussion surface, and wherein when said subordinate percussion surface is in said second collapsed configuration, said subordinate percussion surface is folded over and substantially in contact with said main percussion surface.

14. A practice percussion assembly according to claim 13, said subordinate percussion member further comprising an alternate percussion surface, opposite said subordinate percussion surface, upon which is disposed a third percussion material, said third percussion material being different from said second percussion material, wherein said subordinate percussion member presents a percussion surface in both said expanded and collapsed configurations.

15. A practice percussion assembly according to claim 13, further comprising a spring member, attached to said main percussion member and said subordinate percussion member, for maintaining positioning of said subordinate percussion member under tension spring forces in said first expanded configuration.

16. A practice percussion assembly according to claim 13, further comprising a spring member, attached to said main percussion member and said subordinate percussion member, for maintaining positioning of said subordinate percussion member under tension spring forces in said second collapsed configuration.

17. A practice percussion assembly according to claim 13, further comprising a spring member, attached to said main percussion member and said subordinate percussion member, said spring member locking said subordinate percussion member into both of said first and second configurations.

18. A practice percussion assembly according to claim 17, further comprising a first recess formed in said main percussion member and a second recess formed in said subordinate percussion member, said spring member being disposed in said first and second recesses and attached at one end to said main percussion member and at an opposite end to said subordinate percussion member.

19. A practice percussion assembly according to claim 1, wherein said main percussion member is substantially larger than said subordinate percussion member to simulate the layout of a drum set.

20. A practice percussion assembly according to claim 1, further comprising an additional attachable percussion member attachable to said main percussion member by at least one of an L-bracket, a caliper grip, and a spring grip.

21. A practice percussion assembly according to claim 20, wherein said additional percussion member includes one of a cymbal, a cowbell, a wood block, a washboard, and a tom-tom.

22. A practice percussion assembly, comprising:

a main percussion member having a main percussion surface including a strikable percussion material and at least one side wall; and at least one subordinate percussion member having a subordinate percussion surface including a strikable percussion material and mountable to said main member, said subordinate percussion member having an angled rear wall formed at an angle to a primary plane of said subordinate percussion member, wherein said angled rear wall is adapted to selectively engage said side wall of said main percussion member to be able to maintain said subordinate percussion member at an angle to said main percussion member.

23. A practice percussion assembly according to claim 22, said strikable percussion materials being at least one of solid metal, hollow metal, solid wood, hollow wood, cork, and a rubber sheet.

24. A practice percussion assembly according to claim 22, wherein said strikable percussion material comprises a first percussion material, said subordinate percussion member further comprising an alternate percussion surface, opposite said subordinate percussion surface, upon which is disposed a second percussion material, said second percussion material being different from said first percussion material.

25. A practice percussion assembly according to claim 22, said main percussion member comprising a plurality of side walls, and said at least one subordinate percussion member comprising two subordinate percussion members each including a rear wall angled to said respective subordinate surfaces, said angled rear walls each contactable with one of said side walls, wherein said subordinate percussion surfaces are each mountable at an angle to said main surface.

26. A practice percussion assembly according to claim 25, each of said subordinate percussion members further comprising an alternate surface, opposite said subordinate surface, upon which is disposed an alternate percussion material, said alternate percussion material being different from said percussion material, thereby providing a total of five percussion surfaces in said assembly.

27. A practice percussion assembly according to claim 25, wherein said main percussion member is substantially larger than said subordinate percussion member to simulate the layout of a drum set.

28. A practice percussion assembly according to claim 22, said strikable percussion material comprises a first percussion material, said main percussion member comprising a plurality of side walls, and said at least one subordinate percussion member comprising three subordinate percussion members each including a rear wall angled to said respective subordinate surface, said angled rear walls each contactable with one of said side walls, wherein said subordinate percussion surfaces are each mountable at an angle to said main surface.

29. A practice percussion assembly according to claim 28, each of said subordinate percussion members further comprising an alternate surface, opposite said subordinate surface, upon which is disposed an alternate percussion material, said alternate percussion material being different from said first percussion material thereby providing a total of seven percussion surfaces in said assembly.

30. A practice percussion assembly according to claim 28, wherein said main percussion member is substantially larger than said subordinate percussion member to simulate the layout of a drum set.

31. A practice percussion assembly according to claim 22, wherein said subordinate percussion member is hingedly attached to said main percussion member and is movable between a first expanded configuration and a second collapsed configuration.

32. A practice percussion assembly according to claim 31, wherein when said subordinate percussion member is in said first expanded configuration, said angled rear wall abuts said side wall of said main percussion member and said subordinate percussion surface is disposed at an angle to said main percussion surface, and wherein when said subordinate percussion surface is in said second collapsed configuration, said subordinate percussion surface is folded over and substantially in contact with said main percussion surface.

33. A practice percussion assembly according to claim 32, further comprising a spring member, attached to said main percussion member and said subordinate percussion member, for maintaining positioning of said subordinate percussion member under tension spring forces in said first expanded configuration.

34. A practice percussion assembly according to claim 32, further comprising a spring member, attached to said main percussion member and said subordinate percussion member, for maintaining positioning of said subordinate percussion member under tension spring forces in said second collapsed configuration.

35. A practice percussion assembly according to claim 32, further comprising a spring member, attached to said main percussion member and said subordinate percussion member, said spring member locking said subordinate percussion member into both of said first and second configurations.

36. A practice percussion assembly according to claim 35, further comprising a first recess formed in said main percussion member and a second recess formed in said subordinate percussion member, said spring member being disposed in said first and second recesses and attached at one end to said main percussion member and at an opposite end to said subordinate percussion member.

37. A practice percussion assembly according to claim 22, further comprising an additional attachable percussion member attachable to said main percussion member by at least one of an L-bracket, a caliper grip, and a spring grip.

38. A practice percussion assembly according to claim 37, wherein said additional percussion member includes one of a cymbal, a cowbell, a wood block, a washboard, and a tom-tom.

39. A practice percussion assembly according to claim 22, further comprising a handle attached to a second side wall of said main percussion member.

40. A practice percussion assembly according to claim 22, wherein said main percussion member is substantially larger than said subordinate percussion member to simulate the layout of a drum set.

* * * * *